US010513387B2

(12) United States Patent
De Maillard et al.

(10) Patent No.: US 10,513,387 B2
(45) Date of Patent: Dec. 24, 2019

(54) POUCH RESERVOIRS FOR CASING USED TO DISPENSE PRESSURIZED PRODUCTS AND CASINGS COMPRISING SAME

(71) Applicant: INOSPRAY, Nersac (FR)

(72) Inventors: Thibault De Maillard, Angouleme (FR); Jean-Luc Beurcq, Angouleme (FR)

(73) Assignee: INOSPRAY (FR)

( * ) Notice: Subject to any disclaimer, the term of this patent is extended or adjusted under 35 U.S.C. 154(b) by 0 days.

(21) Appl. No.: 16/020,737

(22) Filed: Jun. 27, 2018

(65) Prior Publication Data

US 2018/0312327 A1 Nov. 1, 2018

Related U.S. Application Data

(63) Continuation of application No. 14/903,965, filed as application No. PCT/EP2014/063869 on Jun. 30, 2014, now Pat. No. 10,035,641.

(30) Foreign Application Priority Data

Jul. 11, 2013 (FR) ..... 13 56841

(51) Int. Cl.

| | |
|---|---|
| ***B65D 83/62*** | (2006.01) |
| ***B65D 83/38*** | (2006.01) |
| ***B65B 3/04*** | (2006.01) |
| ***B65B 61/18*** | (2006.01) |
| ***B65D 83/42*** | (2006.01) |

(52) U.S. Cl.

CPC ..... *B65D 83/62* (2013.01); *B65B 3/04* (2013.01); *B65B 61/186* (2013.01); *B65D 83/38* (2013.01); *B65D 83/42* (2013.01)

(58) Field of Classification Search

CPC ..... B65D 83/62; B65D 83/38; B65D 83/42; B65B 3/04; B65B 61/186

See application file for complete search history.

(56) References Cited

U.S. PATENT DOCUMENTS 4,286,636 A * 9/1981 Credle ..... B65D 83/0055 141/114
5,292,033 A * 3/1994 Gueret ..... B05B 11/3047 222/95

(Continued)

FOREIGN PATENT DOCUMENTS

EP 0765822 4/1997
EP 0776834 6/1997

(Continued)

OTHER PUBLICATIONS

International Search Report, International Application No. PCT/EP2014/063869, dated Sep. 29, 2014.

*Primary Examiner* — Benjamin R Shaw
(74) *Attorney, Agent, or Firm* — Perman & Green, LLP

(57) ABSTRACT

The invention relates to a pouch reservoir for a pressurized dispenser casing, including a dome, a valve-carrying cup and a pouch, such that the dome includes a base for receiving and tightly fixing a neck of the pouch, and a bowl for receiving the valve-carrying cup, the base and the bowl communicating via a central hole for filling the pouch and for discharging the product. The invention is especially applicable to refillable dispenser casings.

12 Claims, 3 Drawing Sheets

(56) References Cited

U.S. PATENT DOCUMENTS 5,343,901 A * 9/1994 Meshberg ..... B05B 11/0037 141/2
5,509,584 A * 4/1996 Gueret ..... B05B 11/0013 222/207
5,772,083 A * 6/1998 Joulia ..... B65D 83/205 222/325
6,073,805 A * 6/2000 Gueret ..... B05B 11/0013 222/95
6,505,986 B1 * 1/2003 Oder ..... A45D 19/02 222/211
8,286,839 B2 * 10/2012 Jasper ..... B65D 83/62 222/105
2005/0155980 A1 * 7/2005 Neuhalfen ..... B65D 83/38 222/95
2006/0049205 A1 * 3/2006 Green ..... B65D 83/303 222/94
2008/0314475 A1 * 12/2008 Fransen ..... B65D 83/62 141/20
2009/0139993 A1 * 6/2009 Last ..... B29C 66/242 220/601
2009/0236363 A1 * 9/2009 Haley ..... B32B 15/08 222/95
2010/0308077 A1 * 12/2010 Sonntag ..... B65D 83/62 222/95
2011/0007987 A1 * 1/2011 Davideit ..... B65D 83/425 383/42
2014/0008389 A1 * 1/2014 Mekata ..... B65D 83/20 222/94
2014/0158719 A1 * 6/2014 Davideit ..... B65D 83/48 222/402.2
2014/0197200 A1 * 7/2014 Hanai ..... B65D 83/32 222/95
2014/0361038 A1 * 12/2014 Mekata ..... B65D 83/384 222/95
2015/0014364 A1 * 1/2015 Greenfield ..... B65D 83/62 222/95
2015/0014990 A1 * 1/2015 Bodet ..... B65D 83/32 285/406

FOREIGN PATENT DOCUMENTS

| | | |
|---|---|---|
| EP | 2488426 | 8/2012 |
| EP | 2551215 | 1/2013 |
| FR | 2785594 | 5/2000 |
| FR | 2987609 | 9/2013 |
| JP | 2013082478 | 5/2013 |
| WO | 9323313 | 11/1993 |
| WO | 2011045538 | 4/2011 |
| WO | 2013076081 | 5/2013 |
| WO | 2013131846 | 9/2013 |

* cited by examiner

POUCH RESERVOIRS FOR CASING USED TO DISPENSE PRESSURIZED PRODUCTS AND CASINGS COMPRISING SAME

CROSS REFERENCE TO RELATED APPLICATIONS

This application is a continuation of U.S. patent application Ser. No. 14/903,965, filed 8 Jan. 2016, which is the National Stage of International Application No. PCT/EP2014/063869, having an International Filing Date of 30 Jun. 2014, which designated the United States of America, and which international Application was published under PCT Article 21(2) as WO Publication No. 2015/003946 A1, and which claims priority from, and the benefit of, French Application No. 1356841, filed on 11 Jul. 2013, the disclosures of which are incorporated herein by reference in their entireties.

BACKGROUND

1. Field

The presently disclosed embodiment concerns pouch reservoirs for casings used to dispense pressurized products and the casings comprising such pouch reservoirs. It applies to casings used to dispense aerosol, liquid or pastelike products under pressure which comprise a pouch reservoir containing the product to be dispensed and in particular to refillable casings.

2. Brief Description of Related Developments

Document EP 2488426 A1 concerns a refillable casing comprising a pouch filled with a product to be dispensed and secured to a dome having a diffuser, the dome being fixed by means of a threaded bushing on an airtight casing designed to be filled with a pressurized gas.

Document EP 2551215 A1 concerns a method of fabrication of a refill device comprising a pouch containing a product to be diffused for a refillable diffuser casing and a refill device adapted to this method.

The method involves the steps of production of the pouch open at one end, filling of the pouch by means of a dispensing device and then fixation of the pouch to a valve. After the step of fixation of the pouch to the valve, the method involves a step of assembly of the valve with a closure cover of the casing, via the bottom of the cover.

The pouch refill device, containing a valve and a pouch, comprises a cover adapted to the fixation of the valve under the cover with the pouch filled. The cover comprises a crown surrounding a circular seat for receiving a cup integrated with the valve.

Document WO2013/076081 A1 concerns a closure device for a refillable diffusing casing comprising a valve mounted in a cup and a connection dome between the cup and an upper flange of a container of the casing, and a diffusing casing containing the latter.

The closure device of the refillable diffusing casing is such that the connection dome comprises one or more support edges of a peripheral beading of the cup and a support collar on the upper flange, the device further comprising a cap provided with an access opening to the valve and adapted to cover the connection dome and be fixed tightly to the container.

These documents in the name of the applicant have the goal of making it easier to fabricate refillable diffusing casings containing a pouch filled with a product to be diffused. For such casings, the filling of the pouch and the ease of manufacture of refills can be further improved, which is one of the purposes of the present invention.

SUMMARY

The presently disclosed embodiment concerns an improvement and pouch reservoirs or refills for pressurized casings for dispensing of products and these casings, having in particular on the one hand the advantage of making the manufacture of these reservoirs or refills easier and on the other hand making possible a better emptying of the pouches during the dispensing of the product which they contain.

To accomplish this, the presently disclosed embodiment proposes a pouch reservoir, for a pressurized dispensing casing, comprising a dome, a valve carrying cup and a pouch, for which the dome comprises a base, for receiving and tight fixation of a neck of the pouch, and a bowl to receive the valve carrying cup, the base at the lower part of the dome and the bowl at the upper part being in communication by a central refill hole for the pouch and exit of the product from the latter.

The first advantage of this aspect is to integrate the pouch with the dome, rather than the valve, which facilitates the refilling of the pouch and the handling of the refill or the reservoir.

The base is advantageously formed by a continuous wall against which the inner wall of the neck of the pouch is applied, the continuous wall having a circular central section and lateral tapering extensions to provide a tight gluing surface for the pouch.

Preferably, the bowl for receiving the valve carrying cup has a peripheral wall provided with a projecting shoulder forming a clamping bead for a collar of the cup.

According to one advantageous aspect, the pouch reservoir comprises an anti-collapse device for the pouch.

More particularly, the anti-collapse device comprises a plunger element which is inserted into the pouch and a retaining plate of the device which is lodged in the bowl.

Advantageously, the plunger element has two distant and laterally staggered blades.

According to one particular aspect, the blades have complementary stop profiles adapted to oppose the blades being aligned one on top of the other.

Advantageously, the plate is mounted forcefully in the bottom of the bowl.

The presently disclosed embodiment further applies to a pressurized dispensing casing having a pouch reservoir and a casing body receiving the pouch of the reservoir.

The dome of the pouch reservoir is advantageously provided with a peripheral support collar of the dome at one edge of the body of the casing.

According to one particular aspect, the pressurized dispensing casing has a bushing for clamping the dome to the body of the casing, being provided with an annular support surface which is tight against the peripheral collar of the dome and the edge of the body of the casing.

The pouch reservoir of the presently disclosed embodiment can advantageously constitute a refill for a refillable casing.

The presently disclosed embodiment moreover concerns a method of production of a pouch reservoir which involves a step of gluing or welding of the pouch to a base beneath the dome, a. a step of filling the pouch assembled to the dome with the product to be dispensed, b. a step of putting the valve carrying cup in place on the dome with the filled pouch.

Advantageously, the dome serves as a holding element for the reservoir during the filling of the pouch.

According to one particular aspect, the cup is crimped on the dome at a station of a pouch filling machine after said filling occurs.

BRIEF DESCRIPTION OF THE DRAWINGS

Other characteristics and advantages of the presently disclosed embodiment shall be apparent from a reading of the following description of a nonlimiting example of the realization of the presently disclosed embodiment making reference to the drawings which show.

DETAILED DESCRIPTION

Figure 1:
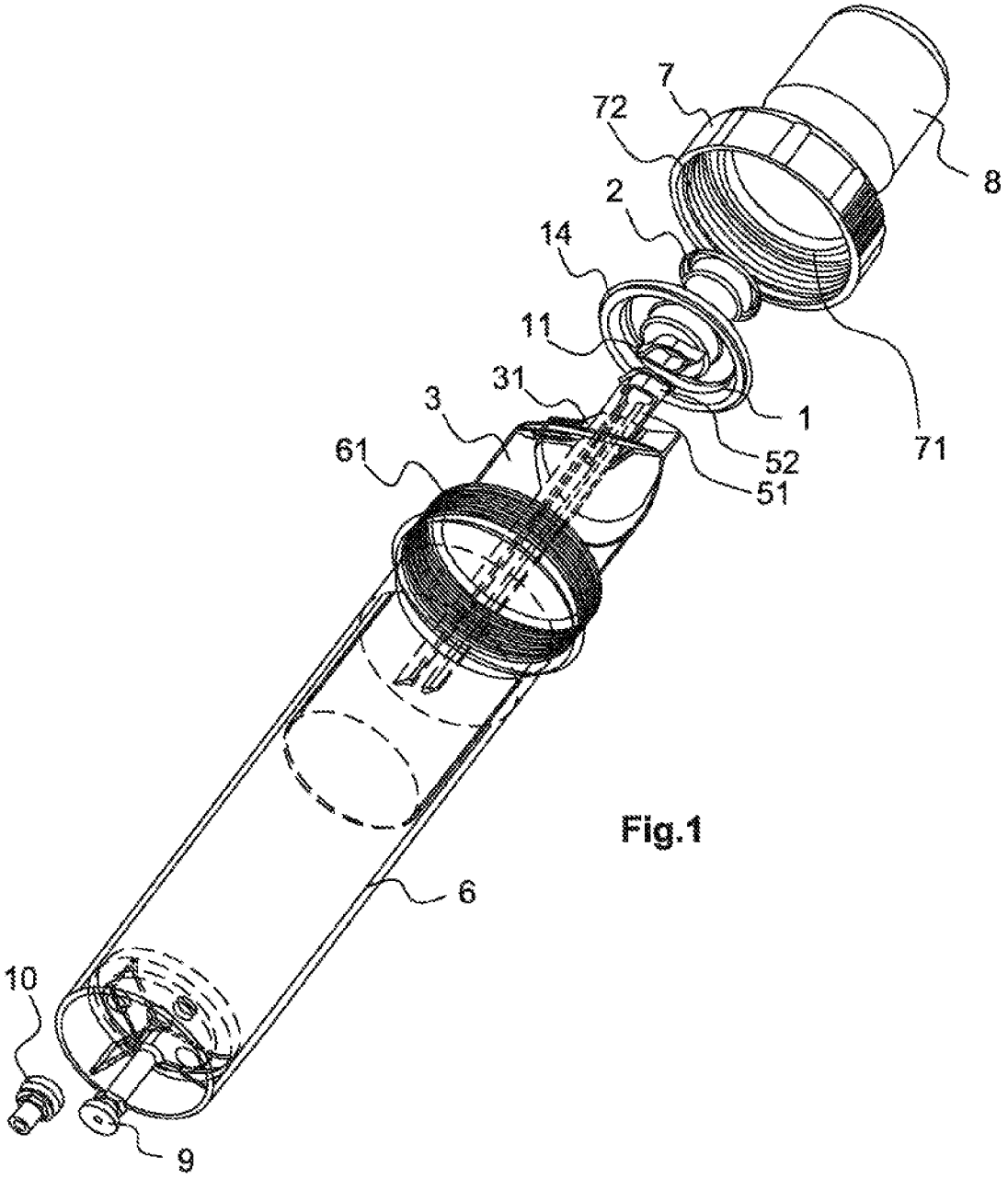
FIG. 1 is a perspective exploded view of a refillable casing according to the presently disclosed embodiment.

FIG. 1 shows in exploded view a pressurized dispensing casing according to the presently disclosed embodiment. It comprises a tubular casing body 6 provided in its bottom with a gas filling valve 10, a safety release valve 9, and in its upper part a threading 61 and an opening for receiving a pouch 3 of a pouch reservoir.

The casing according to the aspect shown receives a bushing 7 provided with threading 72 complementary to the threading of the casing body.

The bushing 7 is designed to hold a cover element of the casing, to close the casing tightly and to resist an internal pressure of the casing of a dozen or so bars.

The cover element of the casing comprises a dome 1 of the pouch reservoir, which receives a cup 2 provided with a valve 4 and which is integrated with the pouch 3 that contain the product to be dispensed.

The device of the presently disclosed embodiment is advantageous in that the dome of the presently disclosed embodiment enables the use of standard cups and valves such as those known for standard pressurized dispensing casings, with or without pouch, which avoids the need to develop specific valves and cups.

Figure 2:
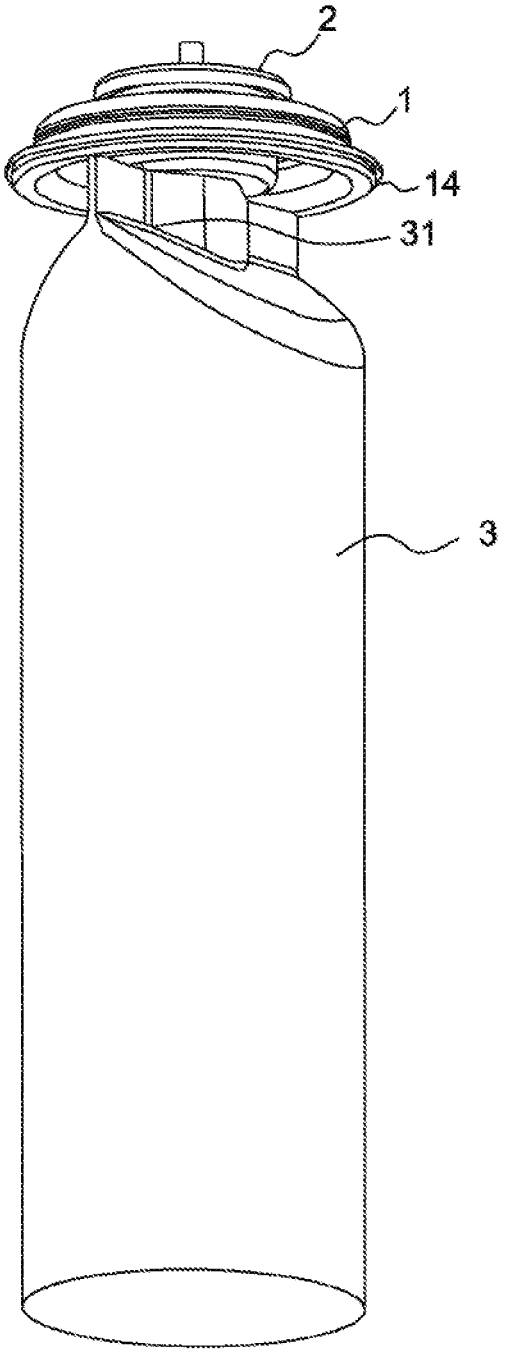
FIG. 2 is a perspective side view of a refill according to the presently disclosed embodiment.

FIG. 2 shows the refill complete with its pouch whose neck 31 is welded to a lower part of the dome 1.

The dome has a peripheral collar 14 which will be applied against an upper edge of the casing to close the casing.

Again looking at FIG. 1, the lower part of the dome 1 to which the neck of the pouch is welded is a base 11 for tightly receiving and fixation of the neck 31 of the pouch 3.

The base 11 which forms a tubular foot of the dome is comprised of a continuous wall perpendicular to the peripheral collar 14 and defining a central tubular opening. The external surface of the base receives the internal wall of the neck 31 of the pouch.

The continuous wall of the base has a central section of general circular shape, which is deformed at two radially opposite sides to form lateral tapering extensions offering a tight gluing surface for the pouch of the "sealing eyelet" type.

Such a biconcave profile is known to be suitable for making a tight welding or gluing of a pouch, especially one used for specific pouch valves.

Figure 4:
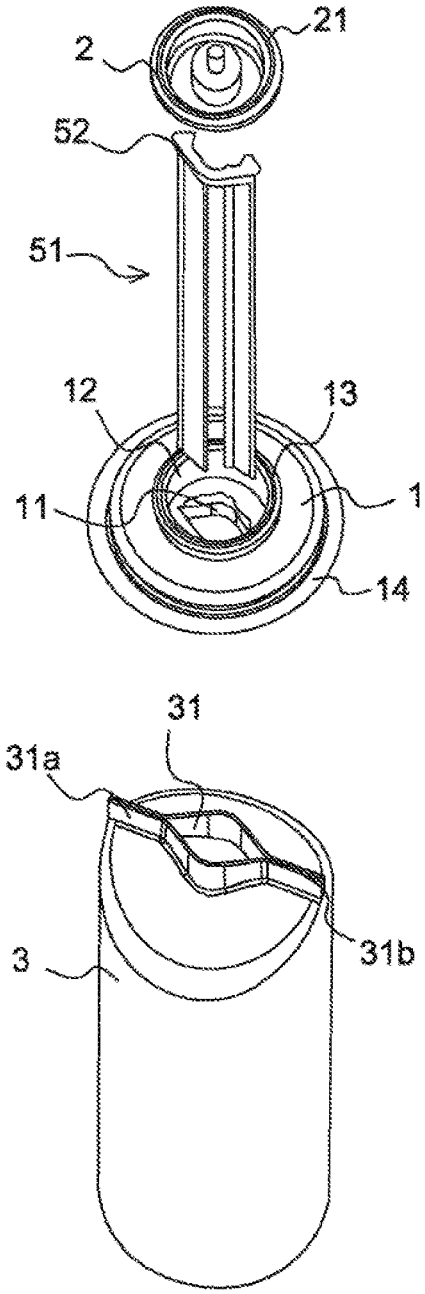
FIG. 4 is a perspective exploded view of the refill of FIG. 2.

The walls 31*a*, 31*b* of the pouch are clamped and glued as shown in FIG. 4, the neck 31 between the clamped walls being welded or glued to the profile of the base 11.

Again considering FIG. 4, the dome 1 contains in its upper part a bowl 12 to receive the valve carrying cup.

The base 11 beneath the dome and the bowl 12 are in communication by a central filling hole of the pouch and for exit of the product.

A first advantage of this aspect is that once the pouch is integrated with the dome, it is possible to fill the pouch by the central hole between the bowl 12 and the base 11, this hole allowing a substantial product flow rate due to its diameter prior to mounting the valve carrying cup.

Thus, it is not necessary to fill the pouch through the valve in the reverse direction, as in the prior art, which is a slow procedure and may result in deterioration of the product characteristics, such as the viscosity of a grease, by altering its molecules during its movement into the valve in the reverse direction.

During the filing of the pouch of the presently disclosed embodiment, the dome which is of much larger diameter than the pouch constitutes a convenient means of grasping the pouch reservoir.

Likewise, the dome serves as a means of grasping and support when one wishes to mount the valve carrying cup on the dome once the pouch has been filled to complete the manufacture of the pouch reservoir.

Figure 5:
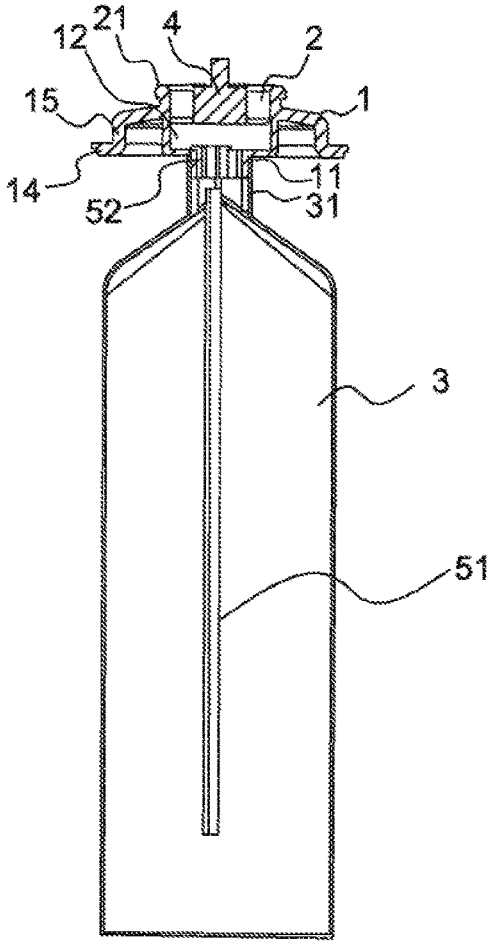
FIG. 5 is a sectional side view of the refill of FIG. 2.

To assemble the cup on the dome in tight and pressure resistant manner, the bowl receiving the valve carrying cup has a peripheral wall provided with a projecting edge 13, as shown in particular in FIG. 4 and in sectional view in FIG. 5. This edge forms a crimping beading for a collar 21 of the cup.

Such an assembly process once more is similar to the assembly processes of known and non-refillable aerosol dispenser cups, which is an advantage because the cup provided with its valve can be the same as for disposable casings without a pouch, and thus does not generate an additional expense.

To manufacture a pouch reservoir according to the presently disclosed embodiment, one performs a step of gluing or welding of the pouch to the base beneath the dome, then one fills the pouch assembled to the dome with the product to be dispensed and puts the valve carrying cup in place on the dome with the pouch filled.

Thus, neither is it necessary to weld the pouch beneath the cup, as the dome provides for the fixation of the pouch, which is yet another advantage of the reservoir of the presently disclosed embodiment.

During these operations and especially during the filling of the pouch, the dome serves as a holding element for the reservoir.

Advantageously, the cup is clamped on the dome at a station of a pouch filling machine after the filling process.

The pouch reservoir of the presently disclosed embodiment can serve as a pouch reservoir for a single-use casing and, in this case, the dome will be glued, welded or crimped on the casing body, for example. It can very advantageously serve for the refilling of a refillable casing, as shown. In this case, the reservoir is positioned on the casing and fixed in tight manner by means of the bushing 7 screwed onto the casing.

Once the dispensing casing has been assembled and placed under pressure with a gas between the wall of the casing and the pouch, a cap 8 is placed on the dome to protect the valve. This cap can be held for example by friction against a vertical wall 15 of the dome.

Figure 3A:
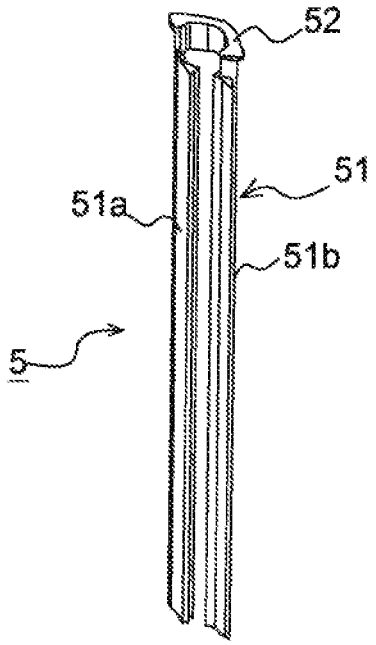
FIGS. 3A and 3B are side and bottom views, respectively, of a plunger element according to one aspect of the presently disclosed embodiment.
Figure 3B:
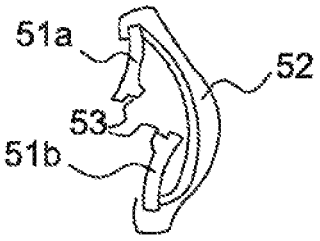

The pouch reservoir shown further comprises an anti-collapse device 5 for the pouch, shown in FIGS. 3A and 3B.

This device is useful in particular if the pouch contains a pastelike product such as a grease to be dispensed.

In fact, for such a product, if the pouch collapses during the exit of the product, it may happen that the collapse occurs at first in its upper section. In such a case, the pouch may become blocked by throttling under the pressure in the casing while product still remains in the bottom part of the pouch.

The described device makes it possible to always maintain a passageway at the centre of the pouch for the product even in event of collapse of the pouch.

It comprises a plunger element 51 inserted into the pouch, as shown in particular by FIG. 5, and a retention plate 52 of the device, which is lodged in the bowl.

Again considering FIG. 3A, the plunger element comprises in this aspect two distant and laterally staggered blades 51*a*, 51*b*. This element is made of a flexible plastic material and in the bottom view of FIG. 3B the blades 51*a*, 51*b* are provided with complementary stop profiles 53 adapted to oppose an alignment of the blades one on top of the other, especially in the area of the lower free end of the blades which will approach each other when the pouch is about to be emptied under the pressure of the gas contained in the casing.

After a dispensing of product, when the pressure is stabilized in the casing, the blades resume a position of rest, being staggered, which restores the volume in the pouch and prevents any throttling.

As shown in FIG. 3A, the plunger element comprises a plate 52, from which the blades 51*a*, 51*b* emerge.

This plate is received in the bowl 12 as shown in FIG. 4. It should be noted that the position of the plunger in FIG. 1 is not precise in the sense that it is shown fully underneath the dome 1, whereas the blades 51*a*, 51*b* pass through the latter in the correct mounting position shown in FIG. 5.

The plate is mounted, for example, forcefully in the bottom of the bowl 12 or it is fixed in any other way to prevent the plunger from rising up in this bowl.

The pouch reservoir of the presently disclosed embodiment has the principal aim of being a refill of a refillable dispensing casing, but it can also be used for a single-use pouch distributor, for example, if the steps of packaging of the product to be dispensed in the pouch and production of the casing are performed at distant sites or if these steps are staggered in time, requiring a temporary storage of the filled pouches.

A major advantage of the presently disclosed embodiment is that the diameter of the pouch is only limited by the diameter of the dome, so that it can practically extend to the internal diameter of the casing.

This is very advantageous with regard to pouch dispensing devices whose casing has a neck forming a dome on which the cup is crimped and whose pouch needs to be of sufficiently reduced diameter or have an elasticity so that it can be inserted into the neck and it cannot be filled in advance without having a very considerable loss of product volume as compared to the volume of the casing.

The presently disclosed embodiment is not limited to the description above, but encompasses variants which lie within the field of the claims and, in particular, the dome preferably made of plastic can possibly be of metal.

What is claimed is:

1. A pouch reservoir, for a pressurized dispensing casing, comprising a dome, a valve carrying cup and a pouch, wherein the dome comprises a base, for watertight attachment of a neck of the pouch, an external surface of the base, receiving an inner wall of the neck of the pouch, said dome comprising further a bowl to receive the valve carrying cup above the base, the base and the bowl being of an unitary construction and in communication by a central hole for refill of the pouch and exit of the product, wherein the bowl is provided by a peripheral wall extending under and above the dome, and wherein said peripheral wall is provided with a projecting edge forming a crimping bead for a collar of the valve carrying cup.

2. The pouch reservoir as claimed in claim 1 wherein the external surface of the base is formed by a continuous wall on which the inner wall of the neck of the pouch is attached, the continuous wall having a circular central section and lateral tapering extensions to provide a tight gluing surface for the pouch.

3. The pouch reservoir as claimed in claim 1 comprising an anti-collapse device for the pouch.

4. The pouch reservoir as claimed in claim 3 wherein the anti-collapse device comprises a plunger element which is inserted into the pouch and a retaining plate received in the bowl.

5. The pouch reservoir as claimed in claim 4 wherein said plunger element has two distant and laterally staggered blades.

6. The pouch reservoir as claimed in claim 5 wherein said blades have complementary stop profiles keeping the blades out of contact with each other.

7. The pouch reservoir as claimed in claim 4 wherein said retaining plate is mounted forcefitted in the bottom of the bowl.

8. The pouch reservoir as claimed in claim 1 constituting a refill for a refillable dispensing casing.

9. A pressurized dispensing casing having a pouch reservoir as claimed in claim 1 and a casing body receiving the pouch of the pouch reservoir, wherein the dome is provided with a peripheral support collar, wherein said body of said casing comprises an edge, said peripheral support collar being received on said edge, said casing comprising further a bushing for clamping the dome to the body of the casing, said bushing being provided with an annular support surface in tight contact against the peripheral collar of the dome and the edge of the body of the casing.

10. A method of producing a pouch reservoir, for a pressurized dispensing casing, said pouch reservoir comprising a dome, a valve carrying cup and a pouch, wherein the dome comprises a base, for watertight attachment of a neck of the pouch, an external surface of the base, receiving an inner wall of the neck of the pouch, and comprises a bowl above the base to receive the valve carrying cup, the base and the bowl being of an unitary construction and in communication by a central hole for refill of the pouch and exit of the product, wherein the bowl is provided by a peripheral wall extending under and above the dome, and wherein said peripheral wall is provided with a projecting edge forming a crimping bead for a collar of the valve carrying cup, said method comprising:

step of gluing or welding of the pouch to an external surface of the base beneath the dome, a step of filling the pouch assembled with the dome with the product to be dispensed through the bowl and the central hole, a step of crimping the collar of the valve carrying cup in place on said bead of the dome with the already filled pouch attached to the dome.

11. A method of producing a pouch reservoir as claimed in claim 10 wherein the dome provides a holding element for the reservoir on a station of a pouch filling machine during the filling of the pouch.

12. A method of producing a pouch reservoir as claimed in claim 10 wherein the cup is crimped on the dome at a station of a pouch filling machine after said filling occurs.

* * * * *